US007815189B1

(12) United States Patent
Jenkins, Jr.

(10) Patent No.: US 7,815,189 B1
(45) Date of Patent: Oct. 19, 2010

(54) PLAYING CARD GAME ACCESSORIES KIT

(76) Inventor: Charles E. Jenkins, Jr., P.O. Box 372, Taftville, CT (US) 06380-0372

( * ) Notice: Subject to any disclaimer, the term of this patent is extended or adjusted under 35 U.S.C. 154(b) by 382 days.

(21) Appl. No.: 11/963,804

(22) Filed: Dec. 22, 2007

(51) Int. Cl.
*A63F 1/12* (2006.01)
*A63F 1/00* (2006.01)

(52) U.S. Cl. ..... 273/149 R; 273/292

(58) Field of Classification Search ..... 273/140, 273/149 R, 27
See application file for complete search history.

(56) References Cited

U.S. PATENT DOCUMENTS

| | | | | |
|---|---|---|---|---|
| D43,857 | S | 4/1913 | Sweet | |
| D313,447 | S | 1/1991 | Zlomke | |
| 5,382,025 | A | 1/1995 | Sklansky et al. | |
| 6,257,580 | B1 | 7/2001 | Brown | |
| 6,402,142 | B1 | 6/2002 | Warren et al. | |
| 6,582,301 | B2 | 6/2003 | Hill | |
| 6,959,925 | B1 | 11/2005 | Baker et al. | |
| 2002/0063389 | A1 * | 5/2002 | Breeding et al. | 273/292 |
| 2005/0206077 | A1 | 9/2005 | Grauzer et al. | |
| 2007/0102879 | A1 * | 5/2007 | Stasson | 273/149 R |

* cited by examiner

*Primary Examiner*—Gene Kim
*Assistant Examiner*—Michael D Dennis

(57) ABSTRACT

This patent discloses a playing card game accessories kit. The kit may include a playing card handler, a gunfighter figurine, a card deck, an advanced card deck, a card cover, chips, and a game card rules book that may provide instructions on how to play continuous draw poker. The playing card handler may include a housing, a controls areas supported by the housing, a distribution area supported by the housing and positioned adjacent to the controls area, and electrical components such as a memory and processor. The controls area may include a two-screen monitor and control keys. The distribution area may include a distribution area divided into a deck tray and a card tray. Arranged rollers may pass cards between the deck tray and card tray. A bridge having a mode screen may divide the deck tray and a card tray.

1 Claim, 6 Drawing Sheets

PLAYING CARD GAME ACCESSORIES KIT

BACKGROUND

1. Field

The information disclosed in this patent relates to an assemblage of accessories that may be utilized in card games.

2. Background Information

A card game includes any game using playing cards, either traditional or game-specific. Playing cards typically include hand-sized rectangular piece of heavy paper or thin plastic having markings that distinguish each card from the other cards. The markings may be utilized to determine its value or other use under the rules of the game being played.

Playing cards were known in China by the year 1120 AD. With such a long history, a variety of card game accessories have been developed. Card game accessories include playing card decks, dealing shoes, discard holders, buttons, visors, card covers, and table tops having particular cloths and layout designs imprinted on those cloths.

Card games typically involve shuffling a deck of cards and then dealing a predetermined number of cards to each player. Each player may draw cards from the deck and discards from their hand to create a good hand in which may be backed by betting. After most card games, a majority of the deck may be left untouched, which is a waste of a shuffle. In addition, the dealer may be taking up a seat that may be utilized by a betting player.

It is desirable to have a device that a betting player could operate to eliminate the problem of a dealer taking up a seat that may be utilized by a betting player while minimizing the amount of human contact with the cards during the deal. What is needed is card game accessories to overcome these and other problems.

SUMMARY

This patent discloses a playing card game accessories kit. The kit may include a playing card handler, a gunfighter figurine, a card deck, an advanced card deck, a card cover, chips, and a game card rules book that may provide instructions on how to play continuous draw poker. The playing card handler may include a housing, a controls areas supported by the housing, a distribution area supported by the housing and positioned adjacent to the controls area, and electrical components such as a memory and processor. The controls area may include a two screen monitor and control keys. The distribution area may include a distribution area divided into a deck tray and a card tray. Arranged rollers may pass cards between the deck tray and card tray. A bridge having a mode screen may divide the deck tray and a card tray.

DETAILED DESCRIPTION

Figure 1:
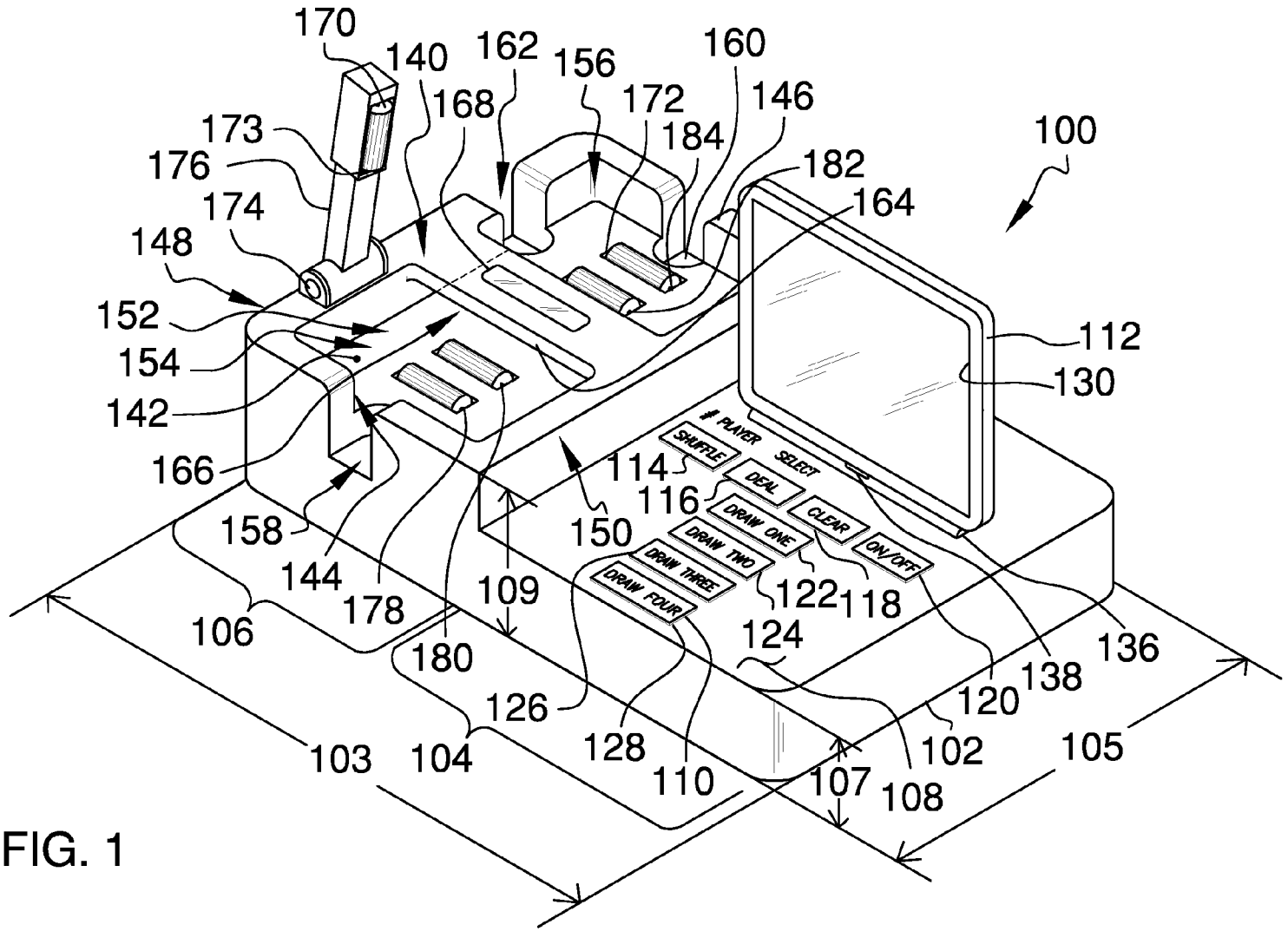
FIG. 1 is an isometric view of a playing card handler 100.

FIG. 1 is an isometric view of a playing card handler 100. Playing card handler 100 may be configured to shuffle and deal playing cards mechanically. Moreover, playing card handler 100 may be configured to verify the validity of individual playing cards and to convey instructions and information to both the person operating playing card handler 100 and the players. Preferably, playing card handler 100 may be utilized in a five card hand card game, such as poker and variations of poker.

Playing card handler 100 may have a housing 102, where housing 102 may include a controls area 104 and a distribution area 106. Housing 102 may be a protective cover configured to contain mechanical and electronic components as well as support mechanical and electrical components. Housing 102 may have a length 103, a width 105, a first height 107, and a second height 109. In one example, length 103 approximately may be ten inches, width 105 approximately may be eight inches, first height 107 approximately may be three inches, and second height 109 approximately may be five inches.

Controls area 104 may be that area of playing card handler 100 where an operator may control the operations of playing card handler 100. Controls area 104 may include a controls area top 108 on which may be positioned a control panel 110 and a monitor 112. Control panel 110 may include mechanical links connected to switches that may make, break, or change the connections in a circuit. Control panel 110 may include a shuffle button 114, a deal button 116, a clear button 118, an on/off button 120 arranged in a row that may parallel a width of monitor 112. Control panel 110 additionally may include a draw one button 122, a draw two button 124, a draw three button 126, and a draw four button 128 arranged in a column positioned deal button 116 and clear button 118 and extending away from deal button 116 and clear button 118.

Shuffle button 114 may be configured to cause a deck of cards in distribution area 106 to be mix into a random order. Deal button 116 may be configured to deal from two to six hands of a predetermined number of cards to start a card game. Prior to a start of a card game, shuffle button 114 may permit an operator to move a cursor to highlight the number of players for that card game on monitor 112 and deal button 116 may permit that operator to then select the number of players for that card game. Controls area top 108 may include text "# Players" and text "Select" above shuffle button 114 and deal button 116, respectively. In one example, text "# Players" and text "Select" are stenciled text.

Clear button 118 may clear a memory of playing card handler 100, dispense all cards in distribution area 106, and start a new card game. On/off button 120 may control a flow of operating power to the electrical components of playing card handler 100. Draw one button 122, draw two button 124, draw three button 126, and draw four button 128 each may cause playing card handler 100 to deal one, two, three, or four cards, respectively, in response to a request by a player for a given number of substitute cards.

Figure 2:
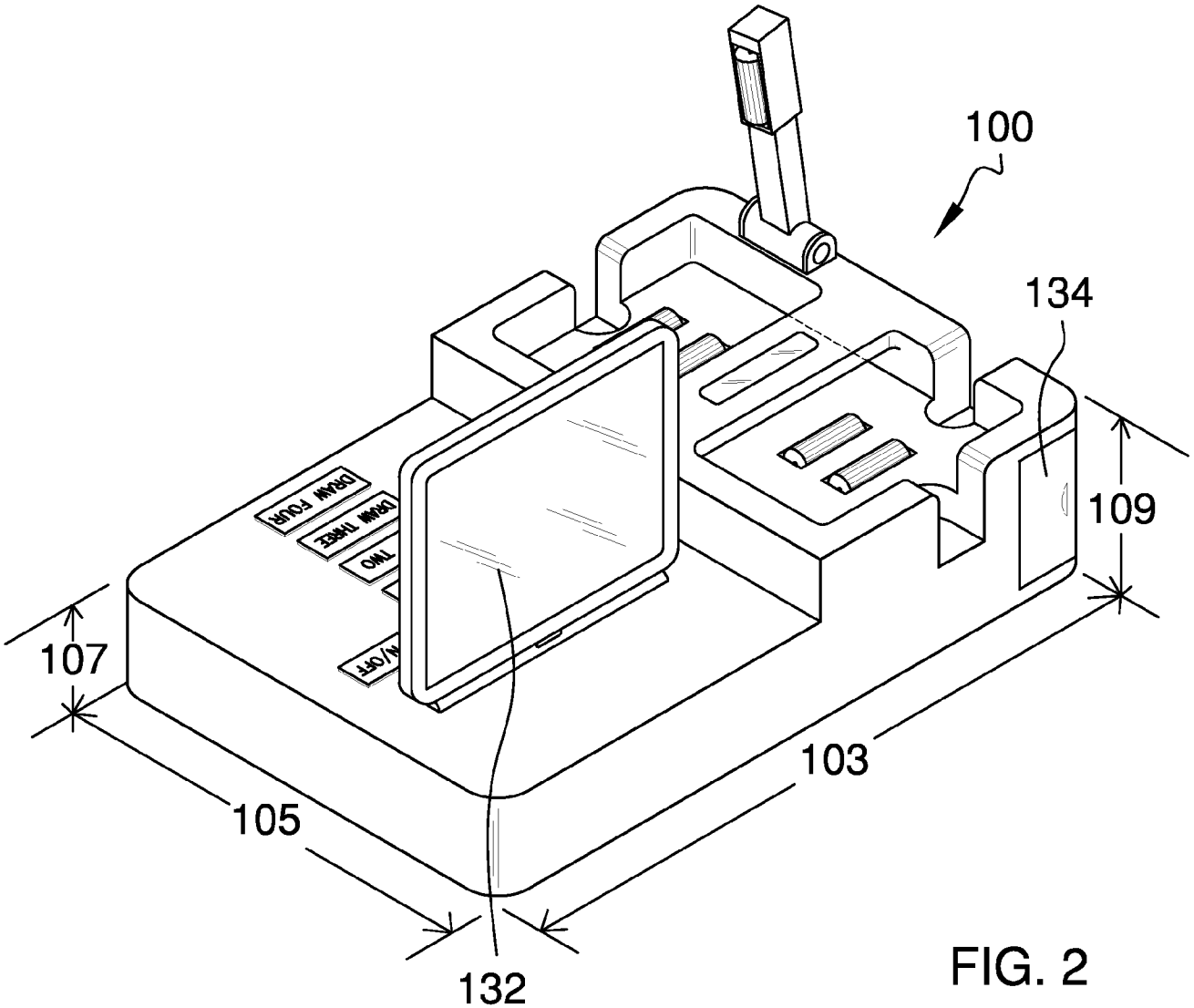
FIG. 2 is an isometric view of playing card handler 100 that may illustrate player screen 132.

Monitor 112 may be a device similar to a television screen that may receive signals from electronics within playing card handler 100 and may display these signals as information on a display screen. Monitor 112 may have a dealer screen 130 arranged to face an operator of playing card handler 100 and a player screen 132 (FIG. 2) arranged to face the remainder of players positioned around playing card handler 100. FIG. 2 is an isometric view of playing card handler 100 that may illustrate player screen 132. Playing card handler 100 may be powered by batteries 135 (FIG. 4) or standard household current and may include a battery compartment 134 (FIG. 2) configured to receive batteries. Monitor 112 may include a monitor hinge 136 to rotate monitor 112 back and forth and a pivot 138 to rotate monitor 112 around a 360-degree circle.

Figure 3:
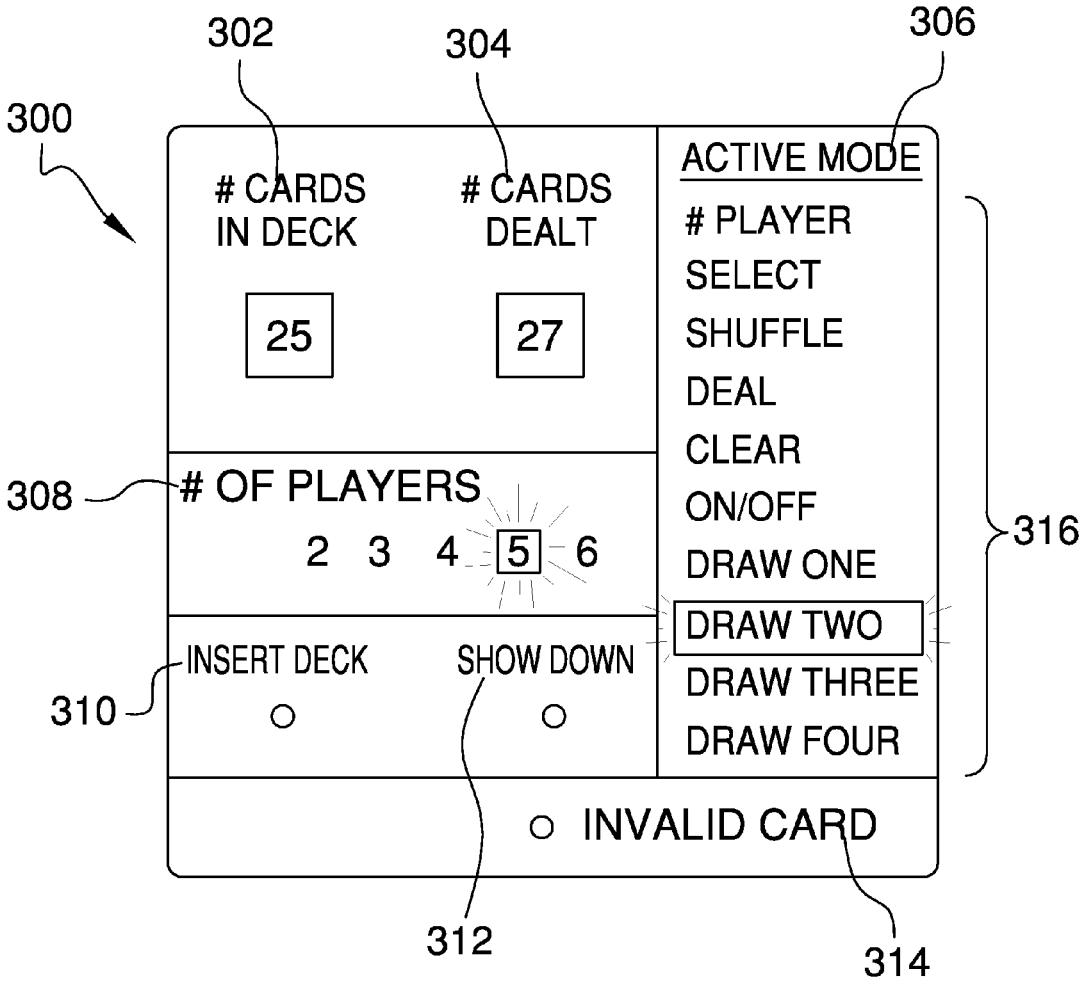
FIG. 3 is a schematic of images 300 that may appear on monitor 112.

FIG. 3 is a schematic of images 300 that may appear on monitor 112. Since a player also may be a dealer (such as operator of playing card handler 100), images appearing on dealer screen 130 (FIG. 1) may be the same as those appearing on player screen 132 (FIG. 2). In addition to various modes, playing card handler 100 may have features to count cards by weighing the cards, to determine the presence of a deck of cards in distribution area 106 by an existence of a weight of cards, and to determine whether a particular card is a valid card by weighing that card.

Accordingly, images 300 may include a deck count 302, a dealt count 304, an active mode image 306, number of players 308, an insert deck image 310, a showdown image 312, and an invalid card image 314. Deck count 302 may be a continuously updated, digital display of the number of cards remaining in a card deck positioned in distribution area 106 and dealt count 304 may be a continuously updated, digital display of the number of cards that have been distributed to players.

Active mode image 306 may include a list of modes 316: Number of players mode, a select number of players mode, a shuffle mode, a deal mode, a clear mode, an on/off mode, a draw one mode, a draw two mode, a draw three mode, and a draw four mode. Playing card handler 100 may highlight the particular mode 316 that presently is active.

When playing card handler 100 is first turned on, shuffle button 114 may function as a number of players button 114 and deal button 116 may function as a number of players select button 116. Playing card handler 100 may ask the operator for number of players. A number of players option ranging from 2-6 may appear on monitor 112. Shuffle button 114 may be pressed to scroll through the numbers until the desired number is highlighted. Deal button 116 may then be pressed to select that number and enter it into a processor contained within playing card handler 100.

If no cards are present in distribution area 106, insert deck 310 may light. If all the cards in the deck have been distributed, then showdown 312 may light to indicate that there are no more cards in the deck. In other words, playing card handler 100 may display 'insert deck' when ready to shuffle and display 'Showdown' after the last card has been drawn. The playing cards may be weighted differently than typical playing cards. If a weight of one card does not meet a predetermined range for a playing card, then invalid card 314 may light.

Distribution area 106 of FIG. 1 may be that area which may receive a deck of playing cards, weigh each card to determine a validity of that card, shuffle the cards, deal the cards, and count the cards. Distribution area 106 may include a distribution area top 140 and a distribution area bottom 142. Distribution area bottom 142 and controls area top 108 may be at the same height, here first height 107 and distribution area top 140 may be at second height 109 above first height 107.

Distribution area 106 may include an operator wall 144, a player wall 146, and a first sidewall 148 and a second sidewall 150 positioned between operator wall 144 and player wall 146. Operator wall 144, player wall 146, first sidewall 148, and second sidewall 150 may meet together to form distribution tray 152. An area of distribution tray 152 adjoined by operator wall 144, first sidewall 148, and second sidewall 150 may form deck tray 154 and an area of distribution tray 152 adjoined by player wall 146, first sidewall 148, and second sidewall 150 may form a card tray 156.

Deck tray 154 may be configured to receive a deck of playing cards from an operator and players may retrieve dealt cards from card tray 156. Operator wall 144 and distribution area bottom 142 may have a deck groove 158 formed therein to permit an operator to place a finger or thumb below a deck of cards positioned in deck tray 154. Player wall 146 and distribution area bottom 142 may have a first card groove 160 formed therein to permit a player to place a finger or thumb below a cards positioned in card tray 156. Additionally, first sidewall 148 and distribution area bottom 142 may have a second card groove 162 formed therein to permit a player to place a finger or thumb below a cards positioned in card tray 156. Since players may be distributed around playing card handler 100, it may be important to have at least two card grooves to that players may have easy access to dealt cards no matter where they sit.

Spanning between first sidewall 148 and second sidewall 150 and bisecting deck tray 154 and card tray 156 may be a bridge 164. Bridge 164 may be elevated above distribution area bottom 142 to form a tunnel 166. Deck tray 154 and card tray 156 may communicate with each other through tunnel 166. On top of bridge 164 may be a mode screen 168. Mode screen 168 may be a small display screen that may display the particular mode 316 (FIG. 3) of playing card handler 100 that presently is active.

To move, distribute, or otherwise dole out the playing cards, distribution area 106 may include a top dole 170 and bottom doles 172. Top dole 170 may include an electrically operated top dole roller 173, where top dole roller 173 may be configured to engage and move an individual card on the top of the card deck from deck tray 154 to card tray 156 through friction by rotating against that card. Top dole 170 may be connected to an arm hinge 174 though an arm 176. Arm hinge 174 may be attached to first sidewall 148 on distribution area top 140 between bridge 162 and operator wall 144. Arm hinge 174 may be a spring-loaded joint that permits rotating and locking arm 176 away from and into deck tray 154. Arm 176 may be a structure that may connect top dole 170 to arm hinge 174.

With a card deck inserted into deck tray 154, arm 176 may be rotated so that top dole roller 173 may be spring biased against that card deck and in particular the top card in that card deck. Top dole roller 173 may be rotated by the processor in playing card handler 100 to shoot the top card through tunnel 166 into card tray 156 and to stop rotating to prevent any remaining cards from being sent to card tray 156.

Bottom doles 172 may include rollers in distribution area bottom 142 that may rotate in response to the processor to move cards between deck tray 154 and card tray 156. In one example, bottom doles 172 may include bottom dole rollers 178, 180, 182, and 184. Bottom dole roller 178 and bottom dole roller 180 may be positioned in deck tray 154 and bottom dole roller 182 and bottom dole roller 184 may be positioned in card tray 156. Each of bottom dole rollers 178, 180, 182, and 184 may be operated independently of the remaining bottom dole rollers. This may aid in moving the playing card on the bottom of the deck in deck tray 154 from deck tray 154 to card tray 156 and in moving the playing card on the bottom of the pile of cards in card tray 156 from card tray 156 to deck tray 154.

Bottom dole roller 180 and bottom dole roller 182 may be positioned adjacent to each other at a distance that is less than a width of the cards but far enough so that a leading edge of the card moves under the existing deck or pile of cards. Also, a top point of each of bottom dole rollers 178, 180, 182, and 184 may be positioned above distribution area bottom 142 to raise the card deck and card pile above distribution area bottom 142 to create a gap between the distribution area bottom 142 and both the bottom of the card deck and the bottom of the card pile above. In this way, bottom cards from one tray may be moved into the bottom position in the other tray. This may be important for shuffling.

Shuffling may be accomplished by manipulating top dole roller 173 and bottom dole rollers 178, 180, 182, and 184. For example, top dole roller 173 may be rotated to send three cards to card tray 156. The order of those three cards will reverse on dropping into card tray 156. The top card will be the bottom card and the number three card will be located on top. Since bottom cards from one tray will move into the bottom position in the other tray, movement of bottom cards from one tray to another also will reverse their order.

The bottom dole rollers 178, 180 then may be rotated to send one card to card tray 156, and then top dole roller 173 may be rotated to send one card to card tray 156. Bottom dole rollers 182, 184 then may be rotated to send four cards from card tray 156 to deck tray 154. The order in which cards may be sent from the top and bottom of the card deck in deck tray 154 to card tray 156 and send from the bottom of the card pile in card tray 156 to deck tray 156 may be controlled by a random number generator such that the movement of the cards may be random. With enough movement of all playing cards, all the playing cards may be mix to make a random order or arrangement of the cards and the cards may be considered shuffled.

Playing card handler 100 may keep track of the number of cards in deck tray 154 and the number of cards in card tray 156 by weighing the cards. Bottom dole rollers 178, 180 of deck tray 154 may be supported by sensitive springs that may be configured to convert their extension into a weight. Bottom dole rollers 182, 184 also may be supported by sensitive springs that may be configured to convert their extension into a weight. The springs may be sensitive enough to determine a weight of one card to the weight of all the cards in the deck. This weight may be correlated to the number of playing cards in a particular tray.

The playing cards utilized in playing card handler 100 may be uniquely weighted in that a left side of the card may weigh more than a right side of the card. The ratio of the weight of the left side to the right side may be known by the processor in the playing card handler 100. When one card lands in card tray 156, bottom dole roller 182 may provide a first weight component and bottom dole roller 184 may provide a second weight component. Each of the cards in the card deck may be weighted individually. If a ratio of the first weight component to the second weight component does not match the weight ratio programmed into the processor, playing card handler 100 may determine that that individual playing card is not a playing card that came with playing card handler 100 and is invalid. This may cause invalid card image 314 of FIG. 3 to illuminate and the card may be removed from the card deck. In addition, playing card handler 100 may be programmed to operate (e.g., shuffle, count, and dispense) only if all cards in the card deck are valid.

Figure 4:
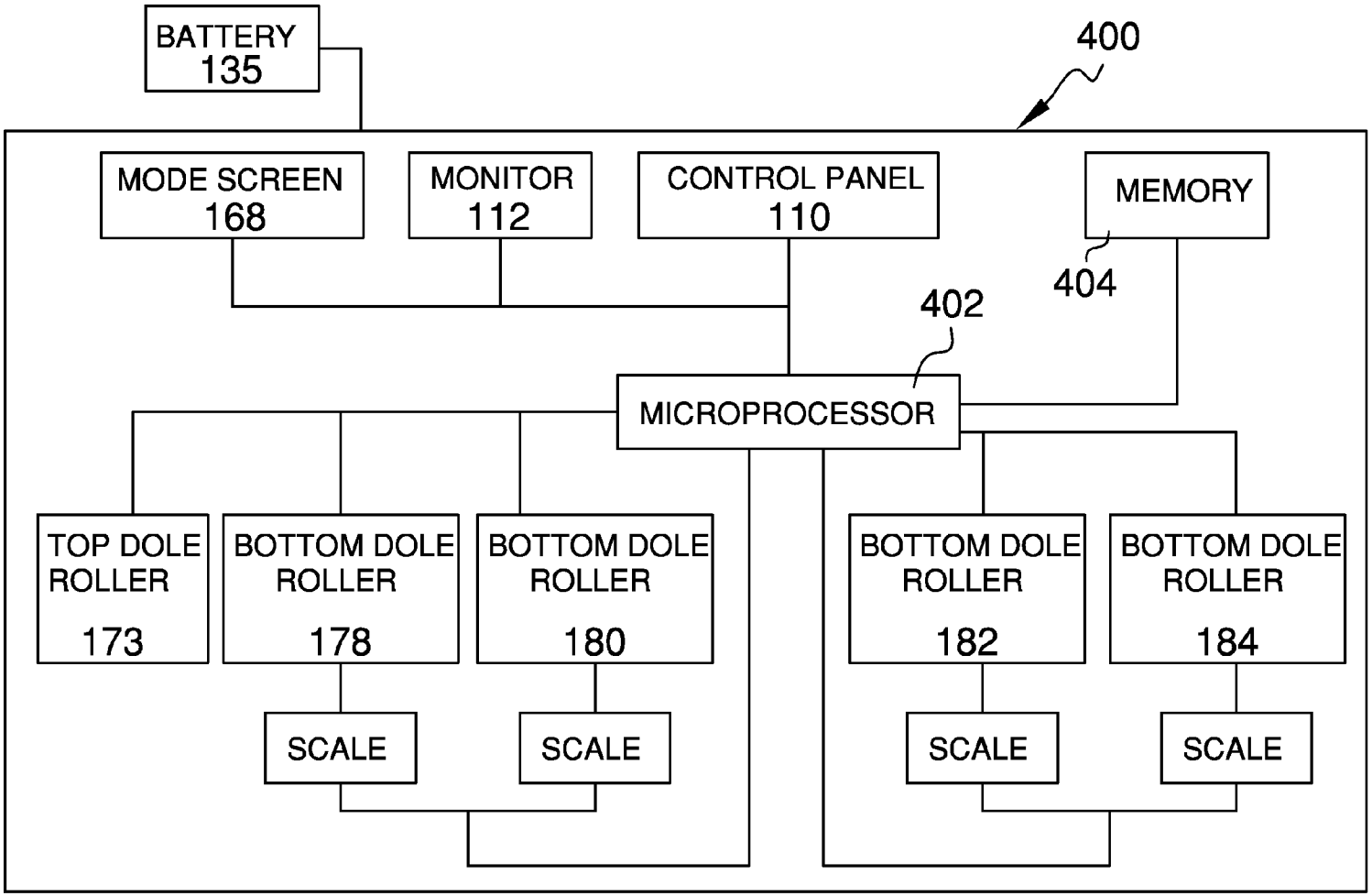
FIG. 4 is a schematic 400 of components that may be included with playing card handler 100.

FIG. 4 is a schematic 400 of components that may be included with playing card handler 100. Schematic 400 may include a microprocessor 402 and a memory 404 configured to be in communications with microprocessor 402. Microprocessor 402 may be a programmable digital electronic component that may incorporates functions of a central processing unit (CPU) on a single semiconducting integrated circuit (IC). A central processing unit (CPU), or sometimes simply processor, may be a component in a digital computer that may processes data and interpret computer program instructions. Memory 404 may include components, devices, and recording media that may retain digital data used for computing for some interval of time. Memory 404 may store operating instructions that, when executed, may cause microprocessor 402 to perform those instructions.

Microprocessor 402 may be configured to be in communications with control panel 110. Microprocessor 402 may be configured to be in communications with top dole roller 173, bottom dole roller 178, and bottom dole roller 180. Bottom dole roller 178 and bottom dole roller 180 each may be configured to be in communications with a scale, and each of those scales may be configured to be in communications with microprocessor 402. Microprocessor 402 may be configured to be in communications with bottom dole roller 182, and bottom dole roller 184 Bottom dole roller 182 and bottom dole roller 184 each may be configured to be in communications with a scale, and each of those scales may be configured to be in communications with microprocessor 402. Battery 135 (FIG. 4) in battery compartment 134 (FIG. 2) may be connected to system 400.

Figure 5:
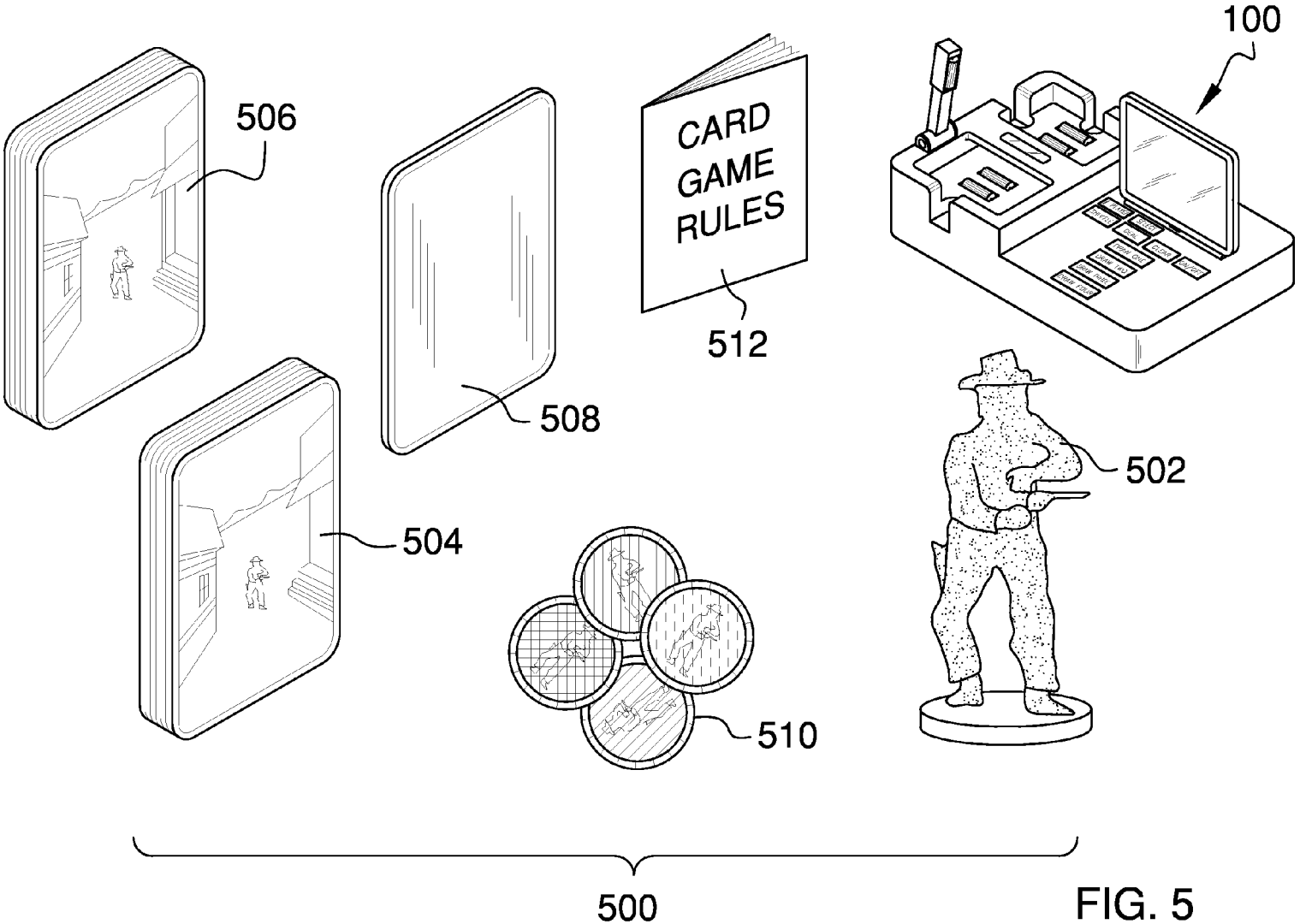
FIG. 5 is a playing card game accessories kit 500.

FIG. 5 is a playing card game accessories kit 500. Card game accessories kit 500 may be an assemblage of accessories that may be utilized in card games. Card game accessories kit 500 may include playing card handler 100, a gunfighter figurine 502, a card deck 504, an advanced card deck 506, a card cover 508, chips 510, and a game card rules book 512.

Playing card handler 100 may be utilized to deal playing cards without taking up a seat of a player bettor. Each player may take a turn at operating playing card handler 100. Playing card handler 100 may work to minimize the amount of human contact with the playing cards during play by more than 50% to create a 50% less chance of cheating.

Gunfighter figurine 502 may be a statuette that may represent a gunfighter (cowboy) in a showdown stance ready to draw. That player who is operating playing card handler 100 may take possession of gunfighter figurine 502 to signify which player is the dealer. Gunfighter figurine 502 may be standing on a flat base to provide stability as gunfighter figurine 502 is passed from player to player. The player in possession of gunfighter figurine 502 (e.g., the dealer) should face gunfighter figurine 502 that player's left to signify that the player to the dealer's left has preference of action.

Card deck 504 may include 52 playing cards. The faces of the cards in card deck 504 may be divided in half between red cards and black cards. These then may be divided into categories of four suits: Spades and Clubs, which may be black, and Hearts and Diamonds, which may be red. Each suit may include cards having face values ranging from high to low: A, K, Q, J, 10, 9, 8, 7, 6, 5, 4, 3, 2. Card deck 504 may exclude jokers. A back of each card may include an image of a gunfighter.

ISO216 specifies international standard (ISO) paper sizes. Playing cards for poker typically come in ISO216-A8 millimeter (mm) size, measuring 52 mm×74 mm, and ISO216-B8 size, measuring 62 mm×88 mm. Playing cards in card deck 504 may utilize A8 or B8 size, but each may have a weight range that will be accepted by playing card handler 100. The playing cards utilized in playing card handler 100 may be uniquely weighted in that one elongated side of the card may weigh more than the other elongated side of the card.

Advanced card deck 506 may be similar to card deck 504, but may omit face values A, K, Q, J, 10, 9, 8, 7, 6, 5, 4, 3, 2 from the cards. Advanced card deck 506 may be limited to including only images of people (e.g., kings, queens) and symbols (spades, hearts, diamonds, clubs).

Card cover 508 may include a gunfighter image on both sides, but otherwise be white. Card cover 508 may go on the bottom of the deck so that players cannot see the face of the bottom card. Card cover 508 may be placed on the bottom of a tray of playing card handler 100 so that it may be in readily in place before the cards are removed from the tray. For example, card cover 508 may be placed in card tray 506 (FIG. 1) before cards are dealt from deck tray 154 to card tray 506. As a player retrieves cards from card tray 506, card cover 508 may block the view of the bottom card in those retrieved cards. Once a player takes possession of the dealt cards, that player may then place card cover 508 back in card tray 156 to cover the bottom card of the next player's draw. Card deck 504 and advanced card deck 506 each may include a card cover 508.

Chips 510 may be available in multiple denominations in an amount that may be divided among (6) six players equally so that each player may start a game with five hundred dollars in chips (tournament style). Chips 510 may be four different colors to represent four different denominations: Black at $100 per chip with three black chips per six players; green at $25.00 per chip with four green chips per six players; red at $5.00 per chip with sixteen red chips per six players; and white at $1.00 per chip with twenty white chips per six players.

Each chip's color may be that of an old western theme wood grain speckled with small bullet holes. The color of grain in the wood and bullet holes may co-inside with the chip's denomination color to make it easier to distinguish the denomination of the chips using something in addition to a color code.

Game card rules book 512 may provide instructions on how to play card games. One card game set out in game car rules book 512 may be continuous draw poker. Continuous draw poker may be a five-hand poker-type card game in which players are compelled to draw and discard until all cards in card deck 504 are dealt. In other words, one hand of continuous draw poker will last until all playing cards in card deck 504 are distributed. An object of continuous draw poker may be to be the player with the best hand after the last card from the deck has been dealt.

Figure 6:
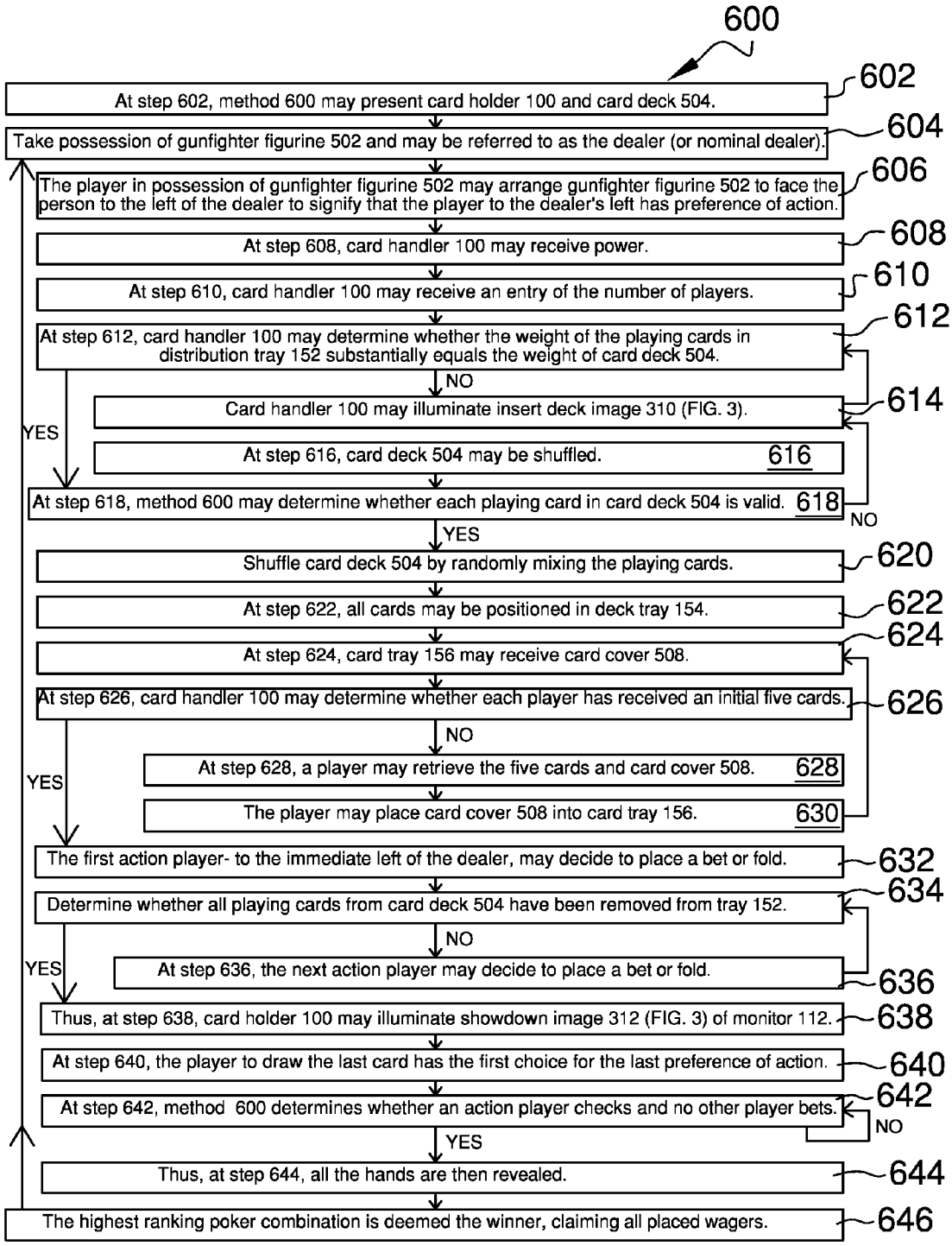
FIG. 6 is a method 600 to play continuous draw poker.

FIG. 6 is a method 600 to play continuous draw poker. Game card rules book 512 may contain a written description of method 600. At step 602, method 600 may present playing card handler 100 and card deck 504. The right to operate playing card handler 100 each hand may rotate among the players and may be marked by possessing gunfighter figurine 502. Alternatively, the right to operate playing card handler 100 for the next hand may go to the player that draws the last card of card deck 504. In a casino, a house dealer may operate playing card handler 100 for each hand. In such a situation, gunfighter figurine 502 may be rotated clockwise among the players to indicate a nominal dealer to determine the order of betting.

At step 604, a player may take possession of gunfighter figurine 502 and may be referred to as the dealer (or nominal dealer). The preference of action may be to the left of the dealer. Thus, at step 606, the player in possession of gunfighter figurine 502 (the dealer or nominal dealer) may arrange gunfighter figurine 502 to face the person to the left of the dealer to signify that the player to the dealer's left has preference of action.

At step 608, playing card handler 100 may receive power. For example, playing card handler 100 may receive power by the dealer pressing on/off button 120 (FIG. 1). There may be 2-6 players for each card deck 504 utilized. At step 610, playing card handler 100 may receive an entry of the number of players. This may free up shuffle button 114 to operate as a shuffle button key instead of a number of players key. At step 612, playing card handler 100 may determine whether the weight of the playing cards in distribution tray 152 substantially equals the weight of card deck 504. If the weight of the playing cards in distribution tray 152 substantially equals the weight of card deck 504, then method 600 may proceed to step 616. If the weight of the playing cards in distribution tray 152 substantially does not equal the weight of card deck 504, then one, two, or all of the cards of card deck 504 may be missing from distribution tray 152 and method 600 may proceed to step 614. At step 614, playing card handler 100 may illuminate insert deck image 310 (FIG. 3) and method 600 may return to step 612.

To begin the game, one or more players may be required to make forced bets to create an initial stake for which the players will contest.

At step 616, card deck 504 may be shuffled. At step 618, method 600 may determine whether each playing card in card deck 504 is valid. This may be accomplished by utilizing bottom dole rollers 182, 184 to weigh each card and compare that weight against weight information stored in memory 404 (FIG. 4). If each playing card in card deck 504 is valid, then method 600 may proceed to step 620. If one playing card in card deck 504 is not valid, then method 600 may return to step 614.

At step 620, method 600 may shuffle card deck 504 by randomly mixing the playing cards until the playing cards are randomly mixed. At step 622, all cards may be positioned in deck tray 154. At step 624, card tray 156 may receive card cover 508. The weight of card cover 508 may unlock deal button 116. At step 626, playing card handler 100 may determine whether each player has received an initial five cards. If each player has received an initial five cards, then method 600 may proceed to step 632. Each of the players may have an opportunity to replace one or more of their cards so long as cards remain in distribution tray 152. If each player has not received an initial five cards, then playing card handler 100 may deal five cards to card tray 156 face down. At step 628, a player may retrieve the five cards and card cover 508. At step 630, the player may place card cover 508 into card tray 156 and method 600 may return to step 624.

At step 632, the first action player—the player to the immediate left of the dealer, may decide to place a bet or fold. Folding may result in the cards of that player being placed in a discard holder and that player forfeiting any pot money (loss of all placed wagers). Any player may fold at any time allowing the remaining players to continue with the folded player (s) placed wagers. If the player bets, then method 600 may proceed to step 634.

After first action player's bet, the player may draw the desired amount of cards at step 634 with a goal of creating the best possible five-card poker hand. All poker ranking combinations may apply. The player must draw at least one card but no more than four cards per draw. A refusal to draw is a forfeit of the hand and the equivalent to folding. The player also must discard from that player's hand the same number of cards that were drawn so that the player's hand remains at five cards. Only one player may discard and draw at a time to regulate the remaining amount of cards to be distributed as the end of the deck nears. The one minimum card draw may vary and a player may be required to pay a predetermined amount per card drawn. To be entitled to draw four cards, have, keep, and show an Ace of any suit.

Players must continue to draw until the end of the deck to stay active in winning the pot. In other words, the drawing and discarding ends when the last card in the deck is distributed. Thus, at step 634, method 600 may determine whether all the playing cards from card deck 504 have been removed from distribution tray 152. If all the playing cards from card deck 504 have been removed from distribution tray 152, then method 600 may proceed to step 638. If not all the playing cards from card deck 504 have been removed from distribution tray 152, then method 600 may proceed to step 636.

At step 636, the next action player may decide to place a bet or fold. The next action player after the first action player would be the player to the immediate left of the first action player. The next action player must match or exceed the previous player's bet to stay active per draw. Thus, a minimum bet may be ideal.

If the next action player folds, that player's cards are placed in a discard holder and that player forfeits any pot money to lose all placed wagers. If the next action player bets, then that player must draw and then discard at least one card. Either way, method 600 returns to step 634.

Once the last card has been distributed, the showdown begins. Thus, at step 638, card holder 100 may illuminate showdown image 312 (FIG. 3) of monitor 112. During the showdown, players may check, bet, or raise the remaining players. Showdown is the only time a bet check may be made. All bets must be matched before hands are revealed.

At step 640, the player to draw the last card has the first choice for the last preference of action. That player may check, bet, or fold. Each player of action after the last card has been draw is forced either to play the hand possessed (bet or check) or fold. At step 642, method 600 determines whether an action player checks and no other player bets. If an action player checks and no other player bets, then method 600 may proceed to step 644. If an action player has not checked or if an action player checks and another player bets, then method 600 may return to step 642.

Once an action player checks and no other player bets or raises, all the hands are then revealed. Thus, at step 644, all the hands are then revealed. The player with the best hand according to the poker variant being played wins the pot. Thus, at step 646, the highest-ranking poker combination is deemed the winner, claiming all placed wagers. Method 600 then may return to step 604.

The game card accessories kit may include new card game accessories for use in playing a fun, poker-style game. The kit may be used at home or may make an ideal casino accessory.

The kit may include a plastic card handler having an internal card shuffler, card dispenser, and electronics. The top of the card handler approximately may measure 10 inches long, 8 inches wide, and 5 inches high. The card handler may feature display screens to indicate bets and game modes. The card handler may have input buttons to input the game phase as well as draw amounts. In addition, trays of the card handler may include built in scales that may weigh the deck to determine the amount of cards left in that deck.

Cards may be placed into a top shuffler and dispensed into a receptacle tray. The card handler may be powered by standard household current or batteries. To utilize the card handler, playing cards may be loaded into the card handler and the card handler may be activated and programmed. The card handler may automatically deal five cards to each player. One betting round may then be held. Each player may then draw up to three cards, or four if that player has an ace. The rounds may continue until all the cards have been drawn from the deck. A final betting round may be conducted, and all players then may show their hands. The highest hand may win the pot.

The card handler may be programmed and used for other poker games such as Texas Hold'em. In addition, the cards and chips may feature a western theme and a gunfighter figurine may be included to be passed to the player who has the bet initiative. This may assist in recreating the feel of a showdown between gunfighters of the old west.

Many players, both at home and at the casino, enjoy card games. Texas Hold'em and other poker games are particularly popular. The kit may fulfill a need for a fun, new casino or home gaming device. Appealing features of the kit may be its entertainment value and convenience. The kit may provide fun for casino patrons and home players who enjoy card games. The card handler automatically may deal out card formations for poker games and may perform all shuffling and dealing functions, thus ensuring speed and accuracy as well as convenience. The kit may be easy to set up and operate, as well as inexpensive and durable.

The information disclosed herein is provided merely to illustrate principles and should not be construed as limiting the scope of the subject matter of the terms of the claims. The written specification and figures are, accordingly, to be regarded in an illustrative rather than a restrictive sense. Moreover, the principles disclosed may be applied to achieve the advantages described herein and to achieve other advantages or to satisfy other objectives, as well.

What is claimed is:

1. A method to play continuous draw poker, the method comprising:

presenting a playing card handler, where the playing card handler includes a housing, a controls areas supported by the housing, where the controls area includes a controls area top on which is positioned a control panel and a monitor, a distribution area supported by the housing and positioned adjacent to the controls area, where the distribution area includes a distribution area top and a distribution area bottom, where the distribution area bottom and the controls area top are at the same height defined as the first height and the distribution area top is at a second height positioned above the first height, where the distribution area includes an operator wall, a player wall, and a first sidewall and a second sidewall positioned between the operator wall and the player wall, where the operator wall, the player wall, the first sidewall, and the second sidewall meet together to form a distribution tray, where an area of the distribution tray adjoined by the operator wall, the first sidewall, and the second sidewall for a deck tray and an area of the distribution tray adjoined by the player wall, the first sidewall, and the second sidewall form a card tray, and electrical components, where the electrical components include a memory and a processor configured to be in communication with the memory, the monitor, and the mode screen;

receiving playing cards in the distribution tray;

providing power to the playing card handler;

entering the number of players in the playing card handler;

determining whether the weight of the playing cards in the distribution tray substantially equals the weight of the card deck;

if the weight of the playing cards in the distribution tray substantially equals the weight of the card deck, then determining whether each playing card in the card deck is valid;

if each playing card in the card deck is valid, then shuffling the playing cards;

distributing an initial five cards to each player by passing one set of five cards from the deck tray to the card tray for each player;

distribute at least one but no more than four cards to each player until all cards in the deck tray have been passed to the card tray and removed from the distribution tray;

illuminating an showdown image after all cards in the deck tray have been passed to the card tray and removed from the distribution tray;

revealing all the hands;

identifying as a winner the player with the best hand according to the poker variant being played; and where if the weight of the playing cards in the distribution tray substantially does not equal the weight of the card deck, then illuminate the insert deck image on the monitor and where if one playing card in the card deck is not valid, then illuminate the invalid card image on the monitor.

* * * * *